US009740221B2

(12) United States Patent
Cavallini et al.

(10) Patent No.: US 9,740,221 B2
(45) Date of Patent: Aug. 22, 2017

(54) METHOD TO LIMIT THE INRUSH CURRENT IN LARGE OUTPUT CAPACITANCE LDO'S

(71) Applicant: Dialog Semiconductor GmbH, Kirchheim/Teck-Nabern (DE)

(72) Inventors: Pier Cavallini, Swindon (GB); Ambreesh Bhattad, Swindon (GB); Liu Liu, Nuremberg (DE)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 410 days.

(21) Appl. No.: 13/852,149

(22) Filed: Mar. 28, 2013

(65) Prior Publication Data

US 2014/0266100 A1 Sep. 18, 2014

(30) Foreign Application Priority Data

Mar. 15, 2013 (EP) ..... 13368009

(51) Int. Cl.
*G05F 1/46* (2006.01)
*G05F 1/575* (2006.01)

(52) U.S. Cl.
CPC ..... *G05F 1/468* (2013.01); *G05F 1/575* (2013.01)

(58) Field of Classification Search
None
See application file for complete search history.

(56) References Cited

U.S. PATENT DOCUMENTS

| | | | | |
|---|---|---|---|---|
| 4,683,529 | A * | 7/1987 | Bucher, II | H02M 1/4225 323/207 |
| 6,208,206 | B1 * | 3/2001 | Leung et al. | 330/107 |
| 6,246,221 | B1 * | 6/2001 | Xi | 323/280 |
| 6,756,838 | B1 * | 6/2004 | Wu et al. | 327/536 |
| 6,862,201 | B2 * | 3/2005 | Hodge, Jr. | H02H 9/001 323/908 |
| 7,459,891 | B2 | 12/2008 | Al-Shyoukh et al. | |
| 2004/0164789 | A1 * | 8/2004 | Leung et al. | 327/546 |
| 2007/0216383 | A1 * | 9/2007 | Al-Shyoukh et al. | 323/280 |
| 2010/0045384 | A1 * | 2/2010 | Fisher et al. | 330/288 |
| 2011/0156672 | A1 | 6/2011 | Gakhar et al. | |

(Continued)

FOREIGN PATENT DOCUMENTS

| | | |
|---|---|---|
| EP | 2 551 743 | 1/2013 |
| JP | 2009189206 | 8/2009 |

OTHER PUBLICATIONS

European Search Report 13368009.0-1807 Mailed:Sep. 19, 2013, Dialog Semiconductor GmbH.

(Continued)

*Primary Examiner* — Nguyen Tran
*Assistant Examiner* — Monica Mata
(74) *Attorney, Agent, or Firm* — Saile Ackerman LLC; Stephen B. Ackerman

(57) ABSTRACT

The present document relates to a pre-charge circuit of electronic circuits having Miller compensation and significant output capacitance such as LDOs or multistage amplifiers. The pre-charge circuit limits an inrush current right after enabling of the electronic circuit. The pre-charge circuit limits and clamps the fast charging of the Miller capacitor. A delay circuit disables the pre-charge circuit when the bias conditions of the Miller capacitor are close to normal bias conditions.

16 Claims, 10 Drawing Sheets

(56) References Cited

U.S. PATENT DOCUMENTS

| | | | | |
|---|---|---|---|---|
| 2012/0098508 | A1 | 4/2012 | Zhu | |
| 2012/0187935 | A1* | 7/2012 | Simons | 323/313 |

OTHER PUBLICATIONS

"Low quiescent current LDO with improved load transient," by S. Strik, et al., Electronics Conference, Oct. 6, 2008, BEC 2008, 11th International Biennial Baltic, IEEE, NJ, USA, 4 pgs.

* cited by examiner

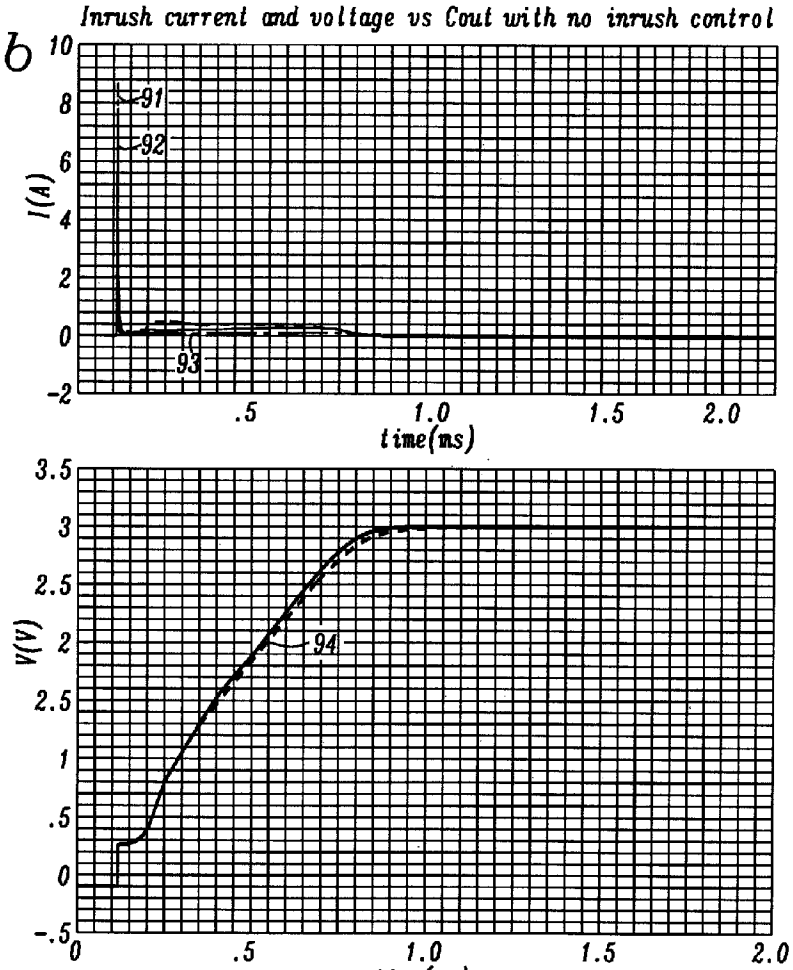
FIG. 9b
FIG. 9c
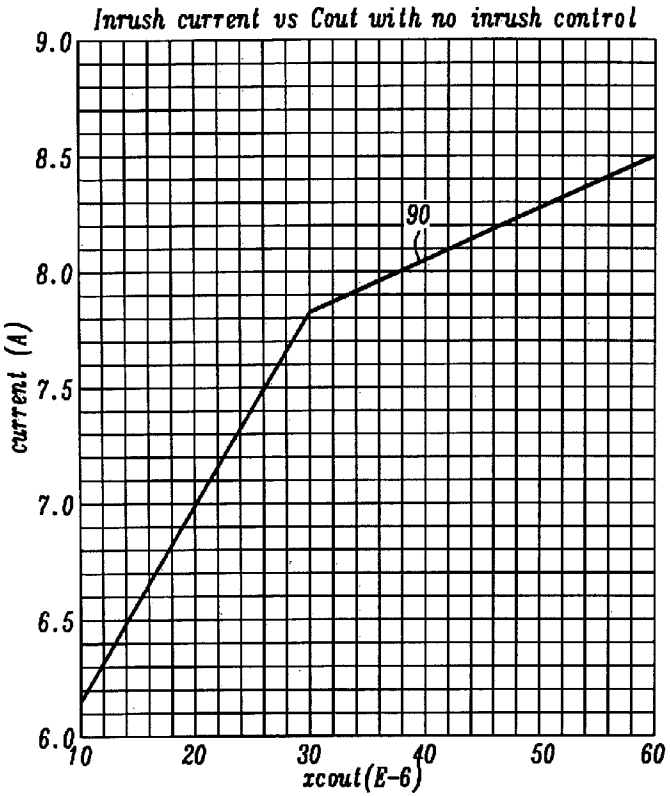
FIG. 9a

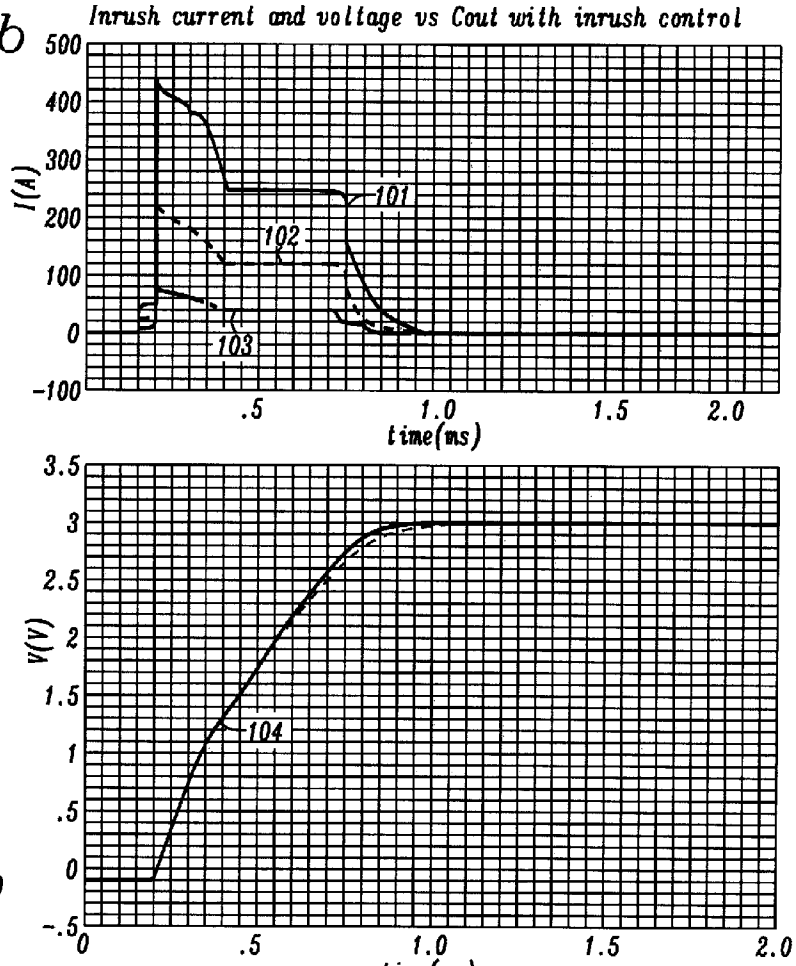
FIG. 10b
FIG. 10c
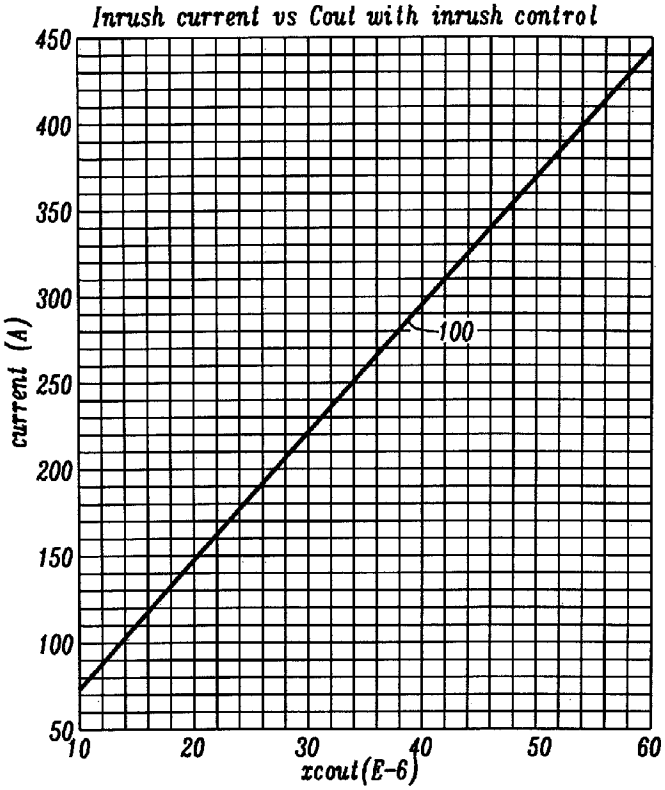
FIG. 10a

METHOD TO LIMIT THE INRUSH CURRENT IN LARGE OUTPUT CAPACITANCE LDO'S

TECHNICAL FIELD

The present document relates to low drop-out (LDO) voltage regulators. In particular, the present document relates to limiting inrush current from a supply during a start-up phase of an LDO regulator or other electronic circuits with Miller compensation connected to a large size external capacitor.

BACKGROUND

Inrush currents must be minimized to avoid large voltage drops on the supply that can cause the system to lock or reset. The use of large decoupling capacitors in parallel to the supply can limit the effect of inrush but requires an increased area on printed boards.

Other integrated solutions addressing the problem might be less effective when the tolerance of external components and the effects of Process, Voltage and Temperature (PVT) variations come into picture.

Therefore it is a challenge for engineers to design LDOs having a limited inrush current in spite of PVT tolerances of components such as an external capacitor.

SUMMARY OF THE DISCLOSURE

A principal object of the present disclosure is to reduce the inrush current of an LDO connected to a large size output capacitor by limiting and clamping the fast charging of a Miller compensation capacitor.

A further object of the disclosure is to pre-charge the Miller capacitor close to the normal bias conditions of the close loop operation of the LDO.

A further object of the disclosure is to reduce the inrush current independent of process, voltage, and temperature conditions and variations.

A further object of the disclosure is to require very small bias current only at start-up time.

A further object of the disclosure is to extend the method disclosed to all multistage amplifiers driving capacitive loads with Miller compensation.

A further object of the disclosure is to control in-rush current of an LDO at the very beginning of the start-up phase when neither the control loop nor the internal current limit circuit are in operation.

A further object of the invention is to reduce cost and area in the printed board by requiring a smaller decoupling capacitor on the supply to limit voltage drops.

In accordance with the objects of this disclosure an electronic circuit configured to reduce inrush current of electronic circuits with a Miller compensation capacitor during a start-up phase only has been disclosed. The circuit achieved comprises the Miller capacitor connected between an output of the circuit and a Miller node of the circuit amplifying an effect of capacitance between the input and output terminals, an input stage of the circuit, a pre-charge circuit configured to pre-charge the Miller capacitor and to clamp a Miller capacitor voltage close to normal operating conditions during a start-up phase only, and a constant current source, generating bias current for the input stage and the pre-charge circuit.

In accordance with the objects of this disclosure a method to reduce inrush current of electronic circuits having a Miller compensation capacitor connected to an output, the method has been disclosed. The method achieved comprises the steps of: providing an electronic circuit having an input stage and a pre-charge circuit and a Miller compensation capacitor connected to capacitive load, pre-charging a terminal of the Miller capacitor, which is connected to an input stage of the electronic circuit, to bias conditions close to normal biasing conditions at the very beginning of a start-up phase of the circuit, clamping a terminal of the Miller capacitor to a voltage close to normal biasing conditions, while the electronic circuit is starting up, and disabling the pre-charging and clamping after a defined timespan being long enough to ensure that the biasing of an input stage of the electronic circuit is close to the final biasing conditions.

SHORT DESCRIPTION OF THE FIGURES

The invention is explained below in an exemplary manner with reference to the accompanying drawings, wherein FIG. 1 illustrates output voltage and supply current of an LDO during start-up.

Figure 8A:
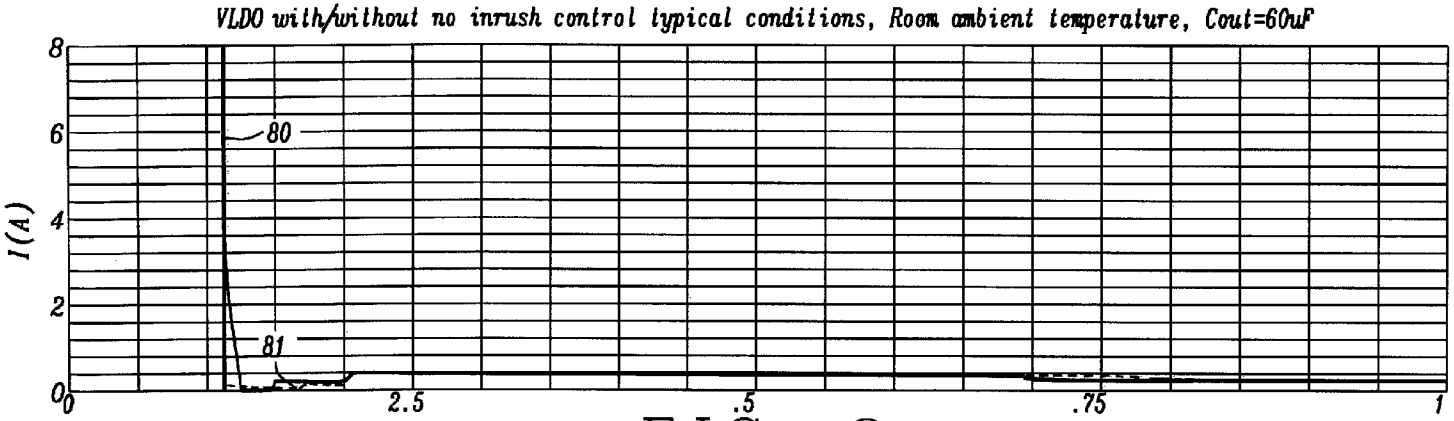

FIG. 8*a* illustrates showing time-charts of output currents of a LDO with and without inrush current control.

Figure 8B:
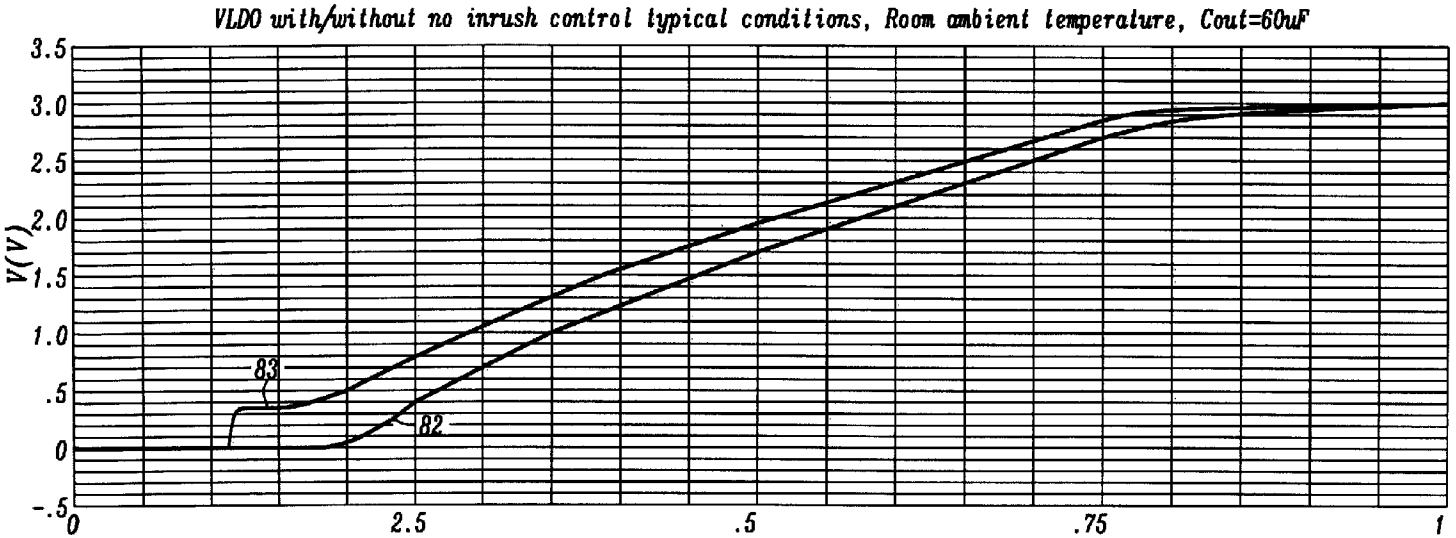

FIG. 8*b* illustrates time-charts of output voltages of a LDO with and without inrush current control.

FIG. 9*a* shows maximum peak values of inrush current of an LDO without inrush current control versus output capacitors of 10, 30 and 60 μF shown on the horizontal scale.

FIG. 9*b* shows peak values of inrush currents without inrush current control using output capacitors of 10 μF, 30 μF, and 60 μF versus time.

FIG. 9*c* shows a time chart of the output voltage using output capacitors of 10 μF, 30 μF, and 60 μF.

FIG. 10*a* shows maximum peak values of inrush current of an LDO without inrush current control versus output capacitors of 10, 30 and 60 μF shown on the horizontal scale.

FIG. 10*b* shows inrush currents with inrush current control using output capacitors of 10, 30 and 60 μF versus time.

FIG. 10*c* shows a time chart of the output voltage. There are only very small differences of the output voltage when using output capacitors of 10, 30 and 60 μF

DETAILED DESCRIPTION

First, the characteristics of a non-limiting example of an LDO regulator regulated at 3.0 V with 60 μF (before voltage and temperature deteriorating effects) capacitor is presented.

Figure 1:
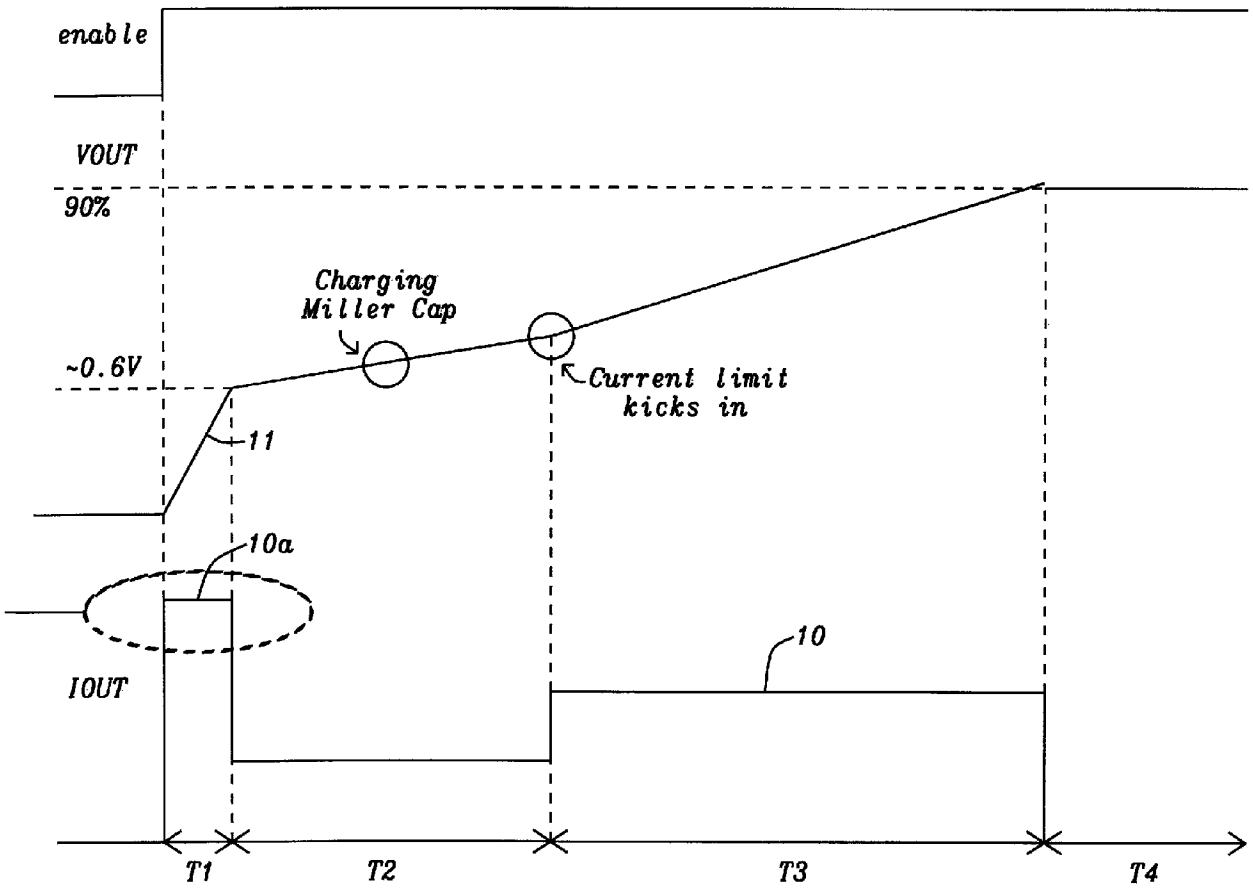

FIG. 1 illustrates output voltage and supply current of such an LDO during start-up. It shows the characteristic of the output voltage (VOUT) 10 and inrush current 11 through the output pass device (IOUT) during start-up.

FIG. 1 shows are four phases of the start-up:

- T1: all internal nodes of the LDO are discharged and biasing up. The output node is charging an external capacitor without control on the output current and a high inrush current 10*a* is possible (as shown in the dashed ellipse), such a high inrush current may be harmful for the circuit and the supply;
- T2: internal slew rate controlled phase: an internal Miller capacitor starts to charge up while an internal LDO current limit circuit has not yet started to operate;
- T3: the internal current limit circuit kicks in;
- T4: the output voltage reaches 90% of the final regulated target value.

Figure 2:
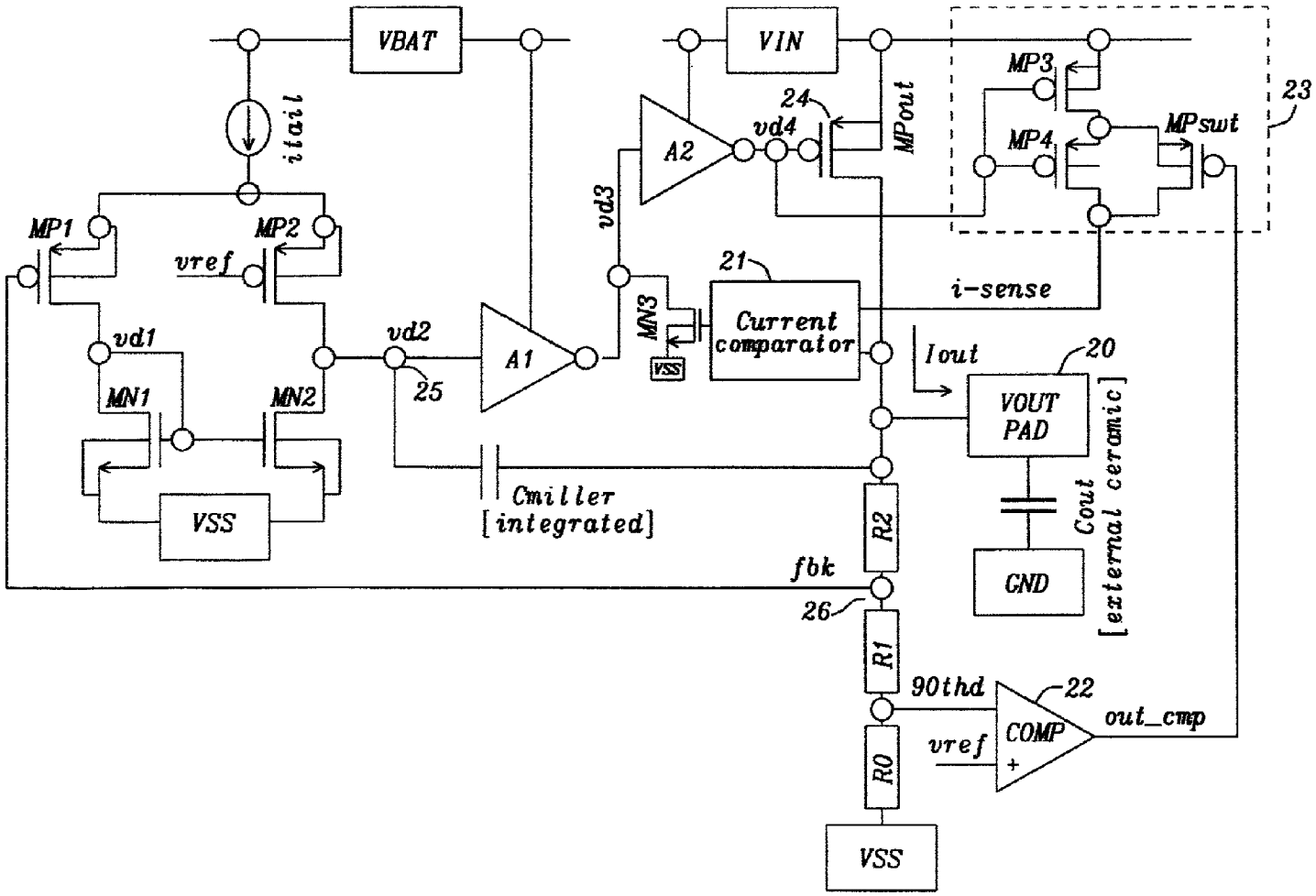
FIG. 2 illustrates a schematic of the proposed LDO circuit.

FIG. 2 illustrates a schematic of an exemplary LDO circuit having an output capacitor connected to a Miller compensation capacitor. FIG. 2 shows three gain stages with internal Miller compensation.

FIG. 2 comprises the components of a basic integrated LDO, namely a pass transistor MPout 24, a voltage divider (R0+R1)/(R0+R1+R2), a feedback node fbk, and a differential pair stage (MP1, MP2 MN1, and MN2) controlling the pass transistor MPout and a Miller capacitor Cmiller. Furthermore an external output capacitor Cout is provided.

A current limit loop comprises feedback node fbk, nodes vd1, vd2, vd3, and vd4, current comparator 21, transistor MN3, and voltage comparator 22, wherein both comparators are connected to a control circuit 23 comprising transistors MPswrt, MP4 and MP3. The gates of MP3 and MP4 are connected to node vd4, which is controlling the gate of the power switch MPout. The gate of MPswt is connected to the output of the voltage comparator 22, which is detecting if the output voltage of the LDO has reached e.g. 90% of the final regulated target voltage. The control circuit 23 provides input to the current comparator 21 which is controlling node vd3 via transistor MN3

The transistors MP3 and MP4 of the control circuit 23 mirror the current lout from the power transistor MPout to the current comparator 21. The ratio of the current mirroring is:

$$\frac{\frac{WMP3}{LMP3}+\frac{WMP4}{LMP4}}{\frac{WMPOUT}{LMPOUT}}=\frac{\frac{W}{L}+\frac{W}{nL}}{\frac{mW}{L}}=\frac{1+\frac{1}{n}}{m},$$

wherein W=channel width, L=channel length, and assuming that all the devices (MP3, MP4, and MPout) have same channel length and channel width but MPout has more units in parallel (m) and MP4 has more units in series (n).

At the beginning of the start-up of the LDO of FIG. 2 the output node (VOUT) 20 is completely discharged, hence the feedback node (fbk) 25 is low. The input differential pair (MP1, MP2; MN1, MN2), building the 1$^{st}$ gain stage, is completely unbalanced (fbk voltage is close to ground voltage and the reference voltage vref is relatively high) and the node vd2 is low forcing the output vd3 of the second gain stage A1 to be high and the output vd4 of the third gain stage A2 to be low. The node vd4 drives directly the gate of the output pass device Mpout, which is connected to the supply voltage VIN. If at start-up the node vd4 is close to ground, the output pass device MPout is completely turned on with a high gate to source voltage and behaves like a switch and a high inrush current is flowing.

It is only when the output vd2 of the differential pair of the 1$^{st}$ stage (MP1, MP2; MN1, MN2) has reached the same level of biasing to match the opposite branch voltage vd1 that the second gain stage A1 and the third gain stage A2 can take control of the regulation loop that the output current is enabled to start to be limited.

Phase T3 is when the current limit kicks in because the circuit requires to operate a minimum Vout.

The voltage at node vd1 is in the preferred embodiment equivalent of gate-source voltage of device MN1 (about 0.6 V), i.e.

The peak output inrush current during phase T1 (the time can be defined in design, i.e. 50 μs) is therefore:

$$I\mathrm{OUT_peak}(T1)=\mathrm{Cout}\times dV/dt;$$

this corresponds in the preferred embodiment:

$$I\mathrm{OUT_peak}(T1)=60\ \mu\mathrm{F}\times 0.6\mathrm{V}/50\ \mu\mathrm{s}=0.72\ \mathrm{A}$$

FIGS. 1 and 2 show that inrush current limitations should be activated in phase 1 already.

Figure 3:
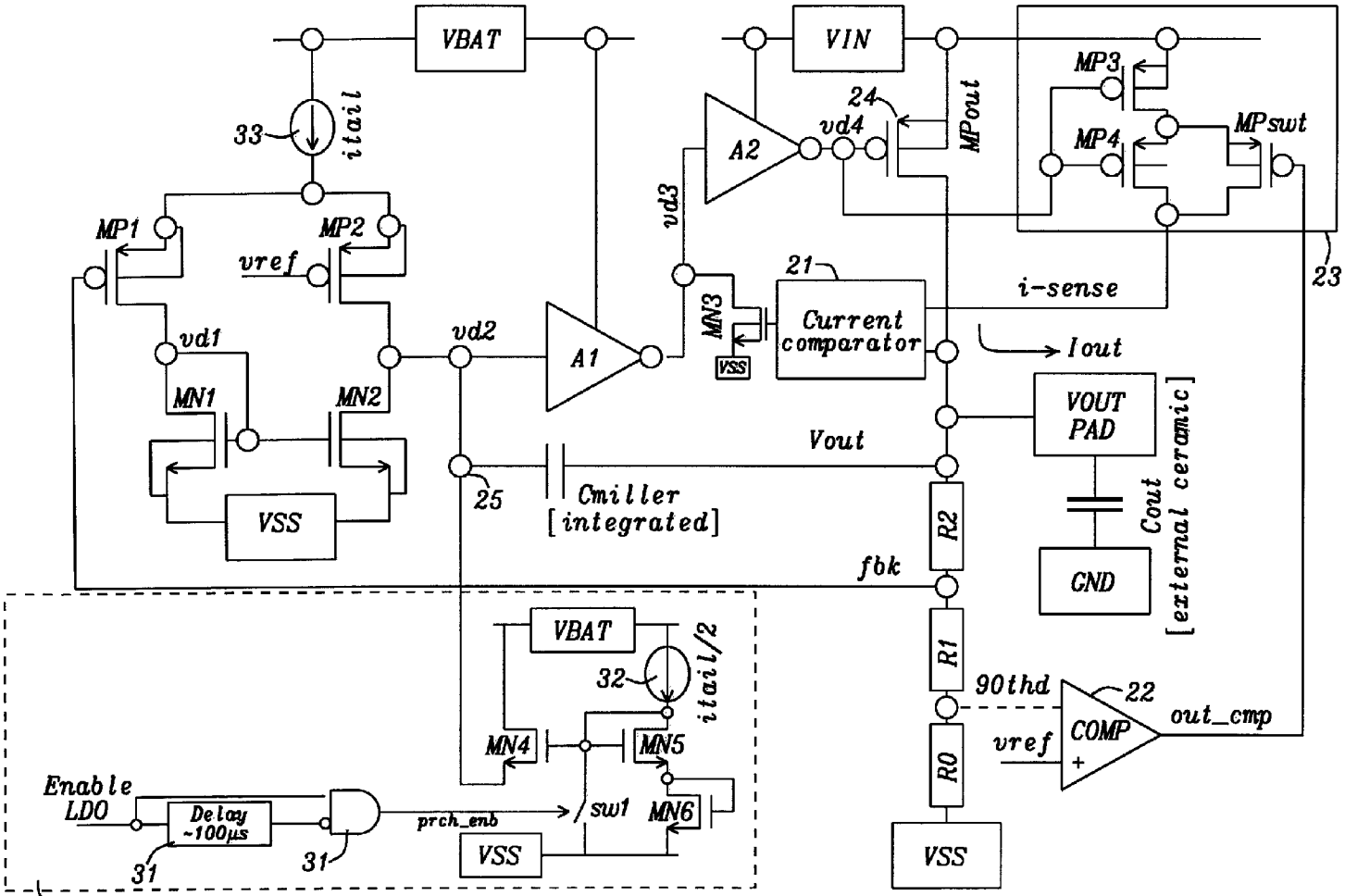
FIG. 3 illustrates a schematic to address the problem of inrush current in phase 1 already by adding a pre-charge circuit.

FIG. 3 illustrates how the problem of inrush current is being addressed in phase 1 already. A pre-charge circuit 30 is activated by an enable LDO signal as soon as the LDO is turned on and will immediately bias node vd2 close to the voltage of node vd1. Pre-charging of the node vd2 is done through a replica MN6 of the MN1 device; hence the circuit can closely track the changes due to PVT variations. A current mode buffer MN4, MN5 has to clamp the voltage at node vd2 while the LDO is powering up. The pre-charge circuit 30 comprises a current mode buffer 40 comprising transistors MN4 and MN5. The pre-charge circuit 30 will remain in operation for a time long enough to ensure that the biasing of the input differential pair MP1, MP2, MN1, MN2 is close to the final biasing conditions. In the example of the preferred embodiment the delay circuit 31 is set to approximately 100 μs, which is long enough to cover for the worst case conditions over PVT corners. After this delay, this pre-charge circuit is turned off and the MN4 device stops providing current; the vd2 node is regulated now by the control loop of the LDO. Furthermore a miller capacitor Cmiller is connected between the output of the LDO and a Miller node 25.

A further improvement to the method (not shown in FIG. 3) is to attach to node vd1, in parallel to device MN1, node a dummy replica of the device MN4 in order to balance the capacitive load between the two branches of the input differential pair MP1, MP2, MN1, and MN2 Furthermore the current source 32 may be scaled with current Rail provided by current source 33.

Figure 4:
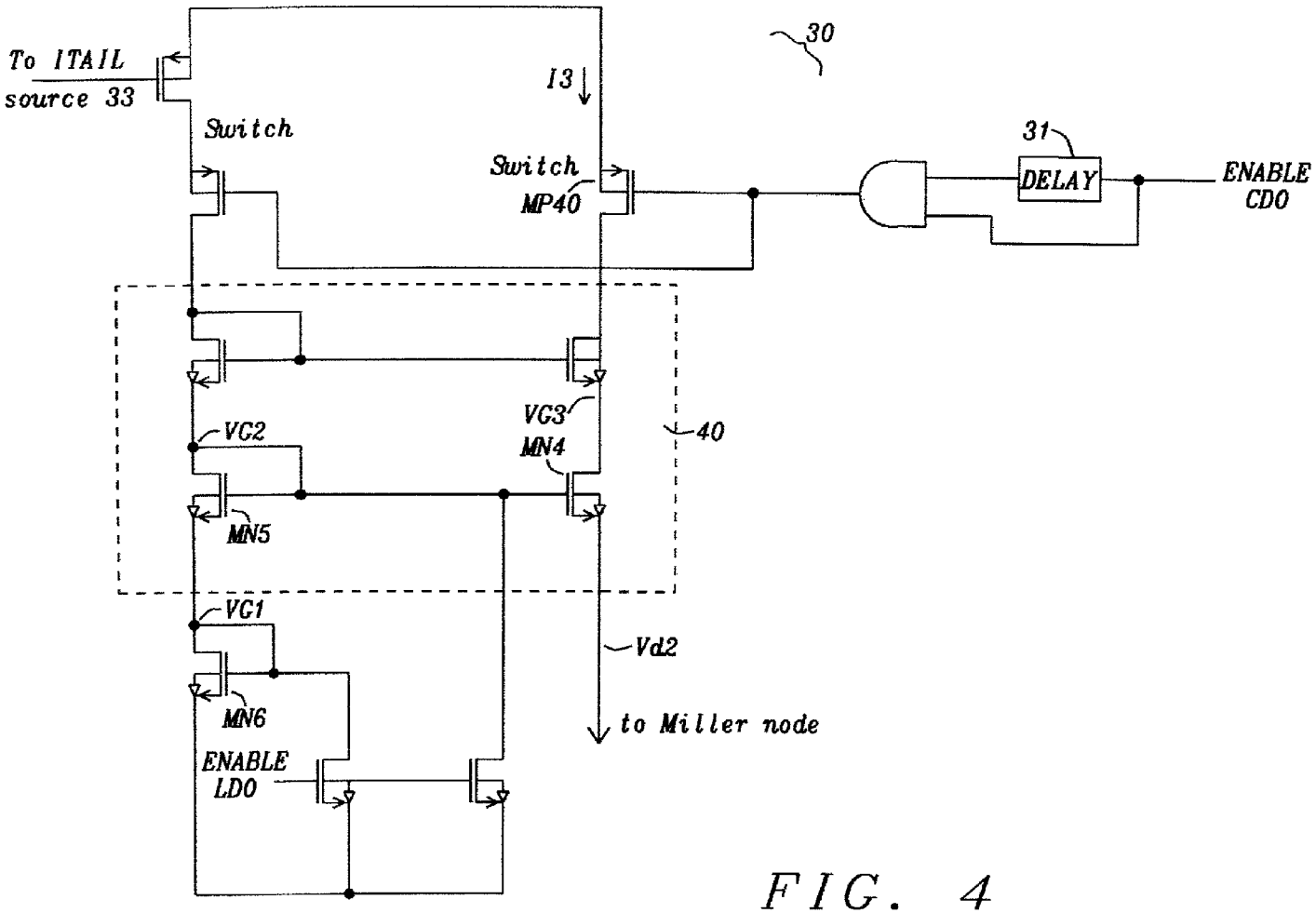
FIG. 4 shows details of the integrated pre-charge circuit for in-rush current control.

FIG. 4 shows details of the integrated pre-charge circuit 30 for in-rush current control as implemented in the exemplary LDO shown in FIGS. 1 and 2. As already shown in the circuit of FIG. 3, FIG. 4 shows the delay circuit 31, and transistor MN6, which is a replica of the MN1. The current mode buffer 40 clamps the voltage at the Miller node vd2 shown in FIG. 3. The pre-charge circuit is disabled after a delay signal from the delay block 31 or in other words biasing of the input differential pair is close to final biasing conditions. In a preferred embodiment the pre-charge circuit 30 is disabled after e.g. about 100 μsecs after an enable signal of the LDO or amplifier circuit.

Transistor MP40 is connected in a current mirror configuration to the current source 33 generating bias current ITAIL for the input stage as shown in FIG. 3. This current mirror is configured in a way that a current ITAIL/2 is provided by transistor MP40 to the pre-charge circuit 30.

Transistors MN5 and MN4 are identical transistors connected in a current mirror configuration, therefore the same current ITAIL/2 flows through both transistors MN5 and MN4, hence voltage VG1 has about the same value as voltage vd1 shown in FIG. 3.

Current ITAIL is the bias current in the main input differential pair. Under normal conditions each branch (MP1+MN1 and MP2+MN2) have a same current ITAIL/2, hence to replicate the vd1 voltage, ITAIL/2 has to be used.

It has to be noted that at start-up point of time the vref pin has a much higher voltage than the fbk pin as the Vout node is charging slowly hence at the very beginning of the start-up there is no current flowing through the MP2+MN2 devices. This way it is easy for the pre-charge circuit 30 to bias the node vd2 to the target value vd1.

Figure 5:
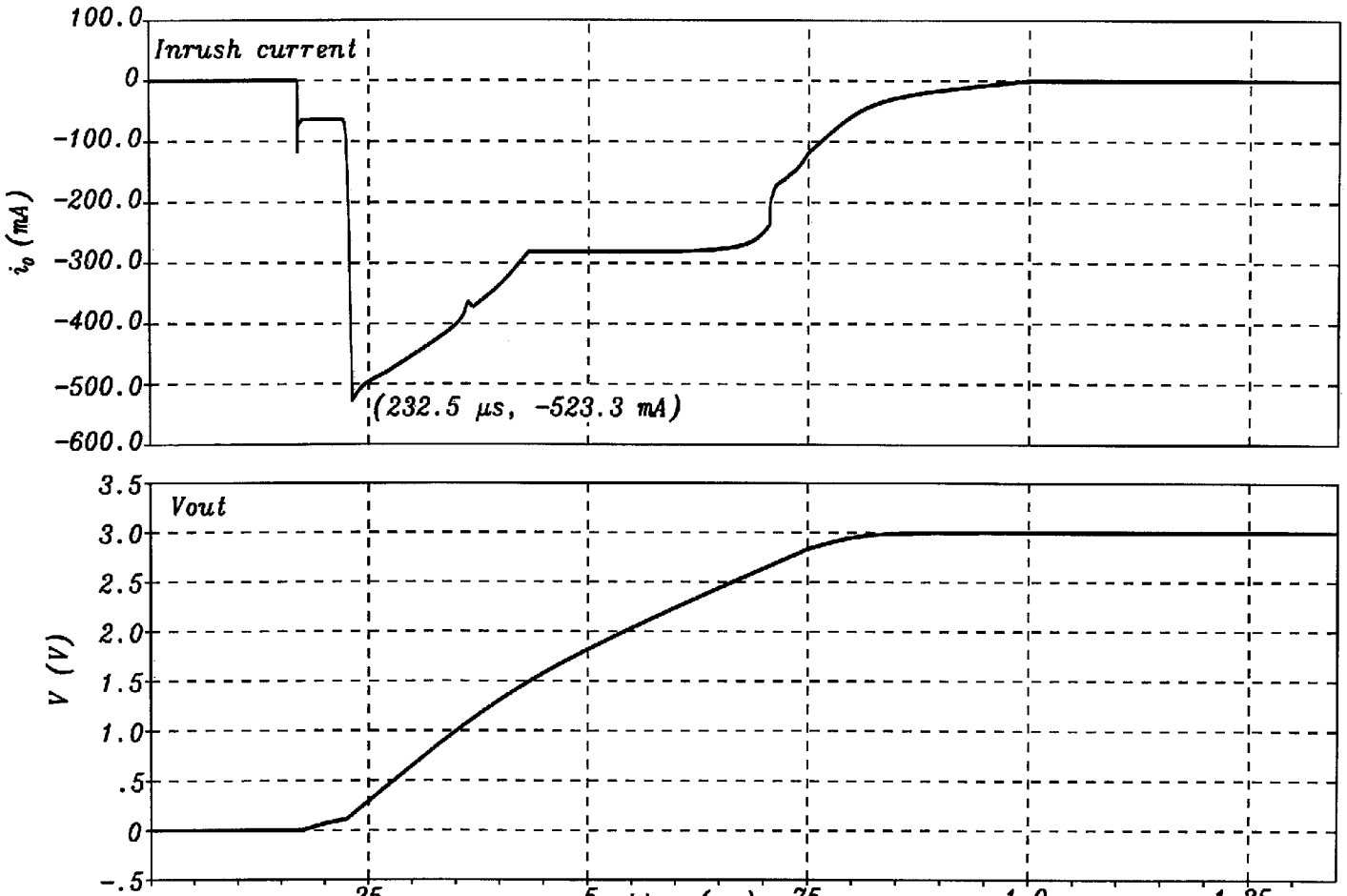
FIG. 5 depicts simulation results showing time-charts of inrush-current and output voltage of an LDO of the present disclosure under worst case conditions when loaded with 60 μF.
Figure 6:
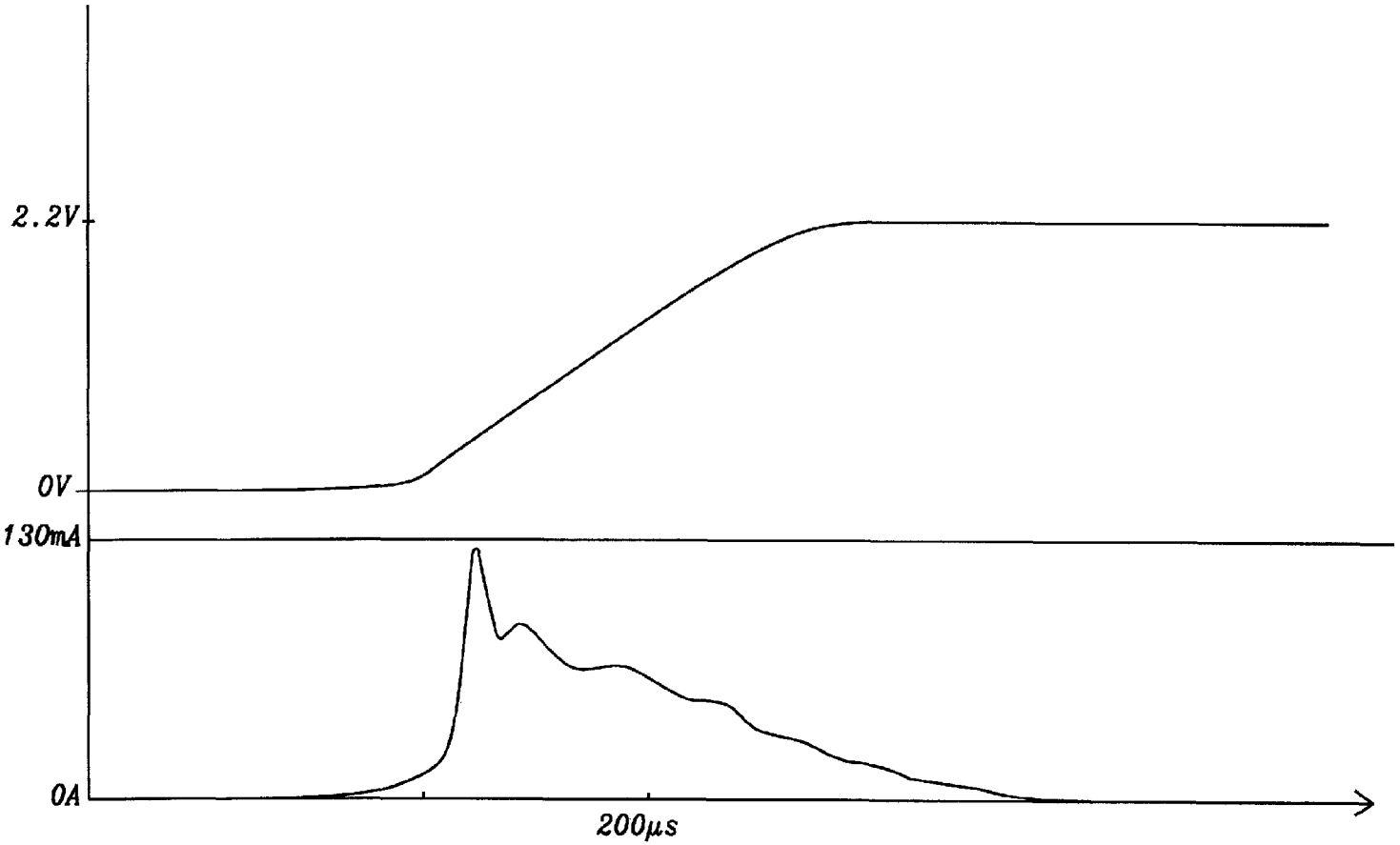
FIG. 6 illustrates silicon results showing time-charts of inrush-current and output voltage of an LDO of the present disclosure under typical conditions when loaded with 10 μF.

FIG. 5 depicts worst case, simulation results showing time-charts of inrush-current and output voltage, regulated at 3.0 V, of an LDO with inrush current control of the present disclosure when loaded with 60 μF. The worst case includes temperature of −40 degrees C. The inrush current has a peak of 523 mA. FIG. 6 illustrates silicon results showing time-charts of inrush-current and output voltage of an LDO, regulated at 2.2 V, of the present invention when loaded with 10 μF. The inrush current has a peak of 130 mA.

FIGS. 5 and 6 show both results from 2 versions of the same LDO. FIG. 5 shows current and voltage diagrams from simulations under worst case conditions, while FIG. 6 shows silicon results of the LDO under typical conditions.

Figure 7:
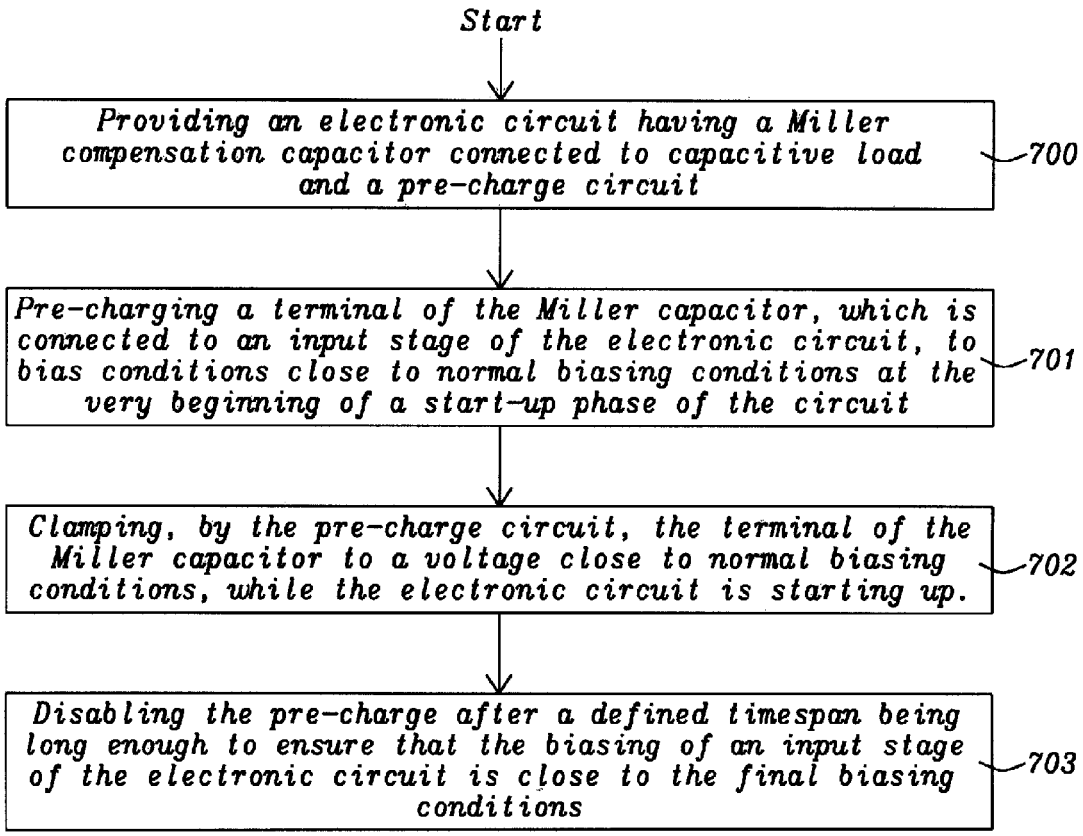
FIG. 7 shows a flowchart of a method to reduce inrush current of electronic circuits having a Miller compensation capacitor connected to capacitive load.

FIG. 7 shows a flowchart of a method to reduce inrush current of electronic circuits having a Miller compensation capacitor connected to capacitive load. A first step 700 depicts a provision of providing an electronic circuit having an input stage and a pre-charge circuit and a Miller compensation capacitor connected to capacitive load. The next step 701 shows pre-charging a terminal of the Miller capacitor, which is connected to an input stage of the electronic circuit, to bias conditions close to normal biasing conditions at the very beginning of a start-up phase of the circuit. Step 702 clamping by the pre-charge circuit the terminal of the Miller capacitor to a voltage close to normal biasing conditions, while the electronic circuit is starting up. Step 703 depicts disabling the pre-charge after a defined timespan being long enough to ensure that the biasing of an input stage of the electronic circuit is close to the final biasing conditions.

It should be noted that the method disclosed to pre-charge and clamp the node vd2 at start-up and consequently reduce the inrush current from the supply voltage VIN is valid in all PVT conditions.

FIGS. 8 *a*+*b* illustrate time-charts comprising an LDO with and without inrush current control with a large capacitor (60 μF) when the output is regulated at 3.0 V. The temperature is ambient temperature, the silicon corner is typical. In FIG. 8*a* curve 80 shows a time diagram of the LDO without inrush current control and the peak on the left hand side of curve 80 shows clearly the problem addressed by the present disclosure. Furthermore in FIG. 8*a* curve 81 illustrates a current diagram with the inrush current control of the present disclosure. The dramatic improvements by the inrush current control are obvious. Curve 82 shows the rise of the output voltage of the LDO with inrush current control and curve 83 shows the rise of the voltage without inrush current control. It should be noted that the maximum inrush current amounts to about 8 A as shown by curve 80.

FIGS. 9 *a-c* illustrate charts of inrush-current versus output capacitances for LDOs without inrush current control. FIG. 9*a* with curve 90 shows maximum peak values of inrush current of an LDO without inrush current control versus output capacitors of 10, 30 and 60 μF shown on the horizontal scale. The peak value of the inrush-current using e.g. 30 μF is about 7.8 A. FIG. 9*b* with curves 91-93 shows peak values of inrush currents without inrush current control using output capacitors of 10 μF (curve 93), 30 μF (curve 92), and 60 μF (curve 91) versus time. Numeral 91 shows a maximum inrush current when using 60 μF, numeral 92 shows a maximum inrush current when using 30 μF, and numeral 93 shows a maximum inrush current when using 10 μF. FIG. 9*c* with curve 94 shows a time chart of the output voltage using output capacitors of 10 μF, 30 μF, and 60 μF versus time. There is not much impact of the different capacitors.

FIGS. 10 *a-c* illustrate charts of inrush-current versus output capacitances for LDOs with inrush current control. FIG. 10*a* with curve 100 shows maximum peak values of inrush current of an LDO without inrush current control versus output capacitors of 10, 30 and 60 μF shown on the horizontal scale. The peak value of the inrush-current using e.g. 30 μF is 220 mA compared to 7.8 as shown in FIG. 9*a* without inrush current control. FIG. 10*b* with curves 101-103 shows inrush currents with inrush current control using output capacitors of 10, 30 and 60 μF versus time. Curve 101 shows a maximum inrush current when using 60 μF, curve 102 shows a maximum inrush current when using 30 μF, and curve 103 shows a maximum inrush current when using 10 μF. FIG. 10*c* with curve 104 shows a time chart of the output voltage. There are only very small differences of the output voltage when using output capacitors of 10, 30 and 60 μF.

It should also be noted that the description and drawings merely illustrate the principles of the proposed methods and systems. Those skilled in the art will be able to implement various arrangements that, although not explicitly described or shown herein, embody the principles of the invention and are included within its spirit and scope. Furthermore, all examples and embodiment outlined in the present document are principally intended expressly to be only for explanatory purposes to help the reader in understanding the principles of the proposed methods and systems. Furthermore, all statements herein providing principles, aspects, and embodiments of the invention, as well as specific examples thereof, are intended to encompass equivalents thereof.

What is claimed is:

1. A method to reduce inrush current of electronic circuits having a Miller compensation capacitor connected to an output, the method comprising the steps of:

(1) providing an electronic circuit having an input stage and a pre-charge circuit, wherein the pre-charge circuit is enabled during a start-up phase only, and a Miller compensation capacitor, which is connected between the input stage and directly to the output of the electronic circuit, wherein the output of the electronic circuit is connected to a capacitive load;

(2) pre-charging by the pre-charge circuit a terminal of the Miller capacitor, which is connected to the input stage, to biasing conditions required for an operation as determined for the electronic circuit after the start-up phase at the very beginning of a start-up phase of the circuit while an internal current limit circuit of the electronic circuit has not yet started to operate;

(3) clamping by the pre-charge circuit the terminal of the Miller capacitor, which is connected to the input stage to a voltage correspondent to normal biasing conditions, while the electronic circuit is starting up; and (4) disabling the pre-charging and clamping after a defined time span to ensure that the biasing of an input stage of the electronic circuit have reached final biasing conditions.

2. The method of claim 1, wherein the disabling of the pre-charging and clamping is activated by a delay circuit after enablement of the electronic circuit, wherein the delay has a duration in an order of a magnitude of 100 μseconds after enablement of the electronic circuit in order to ensure that a smooth transition to an operation as determined for the electronic circuit after the start-up phase is possible.

3. The method of claim 1, wherein said electronic circuit is a Low Drop-Out (LDO) regulator.

4. The method of claim 1, wherein said electronic circuit is a multi-stage amplifier.

5. The method of claim 1, wherein impact of process, voltage, or temperature variations on the electronic circuit are minimized by performing the pre-charging by a transistor of the pre-charge circuit, which is a replica of a transistor of the input stage of the electronic circuit.

6. The method of claim 1, wherein the input stage is biased by a bias current ITAIL, wherein each of two branches of the input stage is biased by a current ITAIL/2 and the pre-charge circuit is also biased by a ITAIL/2 current during start-up phase, wherein a first branch of the input stage is controlled by a feedback voltage of the output voltage of the electronic circuit and a second branch of the input stage is controlled by a reference voltage and wherein the Miller capacitor is pre-charged during start-up phase via a buffer circuit by the current ITAIL/2 to establish biasing conditions as required for the operation as determined for the electronic circuit after the start-up phase across the Miller capacitor, wherein the buffer circuit is part of the pre-charge circuit.

7. An electronic circuit configured to reduce inrush current of electronic circuits with a Miller compensation capacitor during a start-up phase only, wherein the circuit comprises the Miller capacitor connected directly between an output of the circuit and a Miller node of the circuit configured to amplifying an effect of capacitance between a input stage and output terminals of the electronic circuit;

the input stage of the circuit;

a pre-charge circuit configured to pre-charge the Miller capacitor and to clamp a Miller capacitor voltage to operating conditions as required for an operation as determined for the electronic circuit after the start-up phase during a start-up phase only while an internal LDO current limit circuit of the electronic circuit has not yet started to operate and to be disabled when the electronic circuit has reached final biasing conditions; and a constant current source, configured to generating bias current for the input stage and the pre-charge circuit.

8. The circuit of claim 7, wherein the electronic circuit is an LDO.

9. The circuit of claim 7, wherein the electronic circuit is a multistage amplifier.

10. The circuit of claim 7, wherein the pre-charge circuit comprises a current mode buffer configured to providing a current pre-charging the Miller capacitor;

a transistor, which is a replica of a transistor of the input stage of the electronic circuit configured to track changes due to process, voltage, and temperature variations; and a delay circuit configured to disabling the pre-charge circuit when the bias conditions of the Miller capacitor correspond to bias conditions as required for the operation as determined for the electronic circuit after the start-up phase.

11. The circuit of claim 7, wherein the pre-charge circuit is disabled by the delay circuit after enablement of the electronic circuit in order to ensure that a smooth transition to the operation as determined for the electronic circuit after the start-up phase is possible.

12. The circuit of claim 7, wherein the input stage is biased by a bias current ITAIL generated by the current source, wherein each of two branches of the input stage is biased by a current ITAIL/2 and the pre-charge circuit is also biased by a ITAIL/2 current during start-up phase during start-up only, wherein a first branch of the input stage is controlled by a feedback voltage of the output voltage of the electronic circuit and a second branch of the input stage is controlled by a reference voltage and wherein the Miller capacitor is pre-charged by the pre-charge circuit during start-up phase only via a buffer circuit by the current ITAIL/2 to establish biasing conditions as required for the operation as determined for the electronic circuit after the startup phase across the Miller capacitor, wherein the buffer circuit is part of the pre-charge circuit.

13. The circuit of claim 12, wherein the buffer circuit comprises a current mirror comprising two identical transistors.

14. The circuit of claim 12, wherein corresponding transistors of both branches of the input stage are matching transistors.

15. The method of claim 1, wherein the precharging of the terminal of the Miller capacitor and clamping of the Miller capacitor voltage is performed until a potential of the Miller capacitor is reached which prevents inrush currents damaging the circuit.

16. The circuit of claim 7, wherein the precharging of the terminal of the Miller capacitor and clamping of the Miller capacitor voltage is performed until a potential of the Miller capacitor is reached which prevents inrush currents damaging the circuit.

* * * * *